US008800945B2

(12) United States Patent
Brasell et al.

(10) Patent No.: US 8,800,945 B2
(45) Date of Patent: Aug. 12, 2014

(54) POOL CADDY

(75) Inventors: James Michael Brasell, Canyon Lake, TX (US); Sandra Lee Brasell, Canyon Lake, TX (US); Justin Michael Brasell, Houston, TX (US)

(73) Assignee: James M. Brasell, Canyon Lake, TX (US)

( * ) Notice: Subject to any disclaimer, the term of this patent is extended or adjusted under 35 U.S.C. 154(b) by 86 days.

(21) Appl. No.: 13/205,499

(22) Filed: Aug. 8, 2011

(65) Prior Publication Data

US 2013/0037665 A1 Feb. 14, 2013

(51) Int. Cl.
*F16B 45/00* (2006.01)

(52) U.S. Cl.
USPC ..... 248/306; 248/684; 211/106.01

(58) Field of Classification Search
USPC ..... 248/683, 686, 690, 692, 693, 317, 339, 248/309.3, 304, 306, 305, 309.1, 205.5, 248/206.2; 211/85.31, 85.29, 85.17, 71.01, 211/87.01, 106.01, 106, 119, 113, 119.009; 220/485, 491, 494, 480, 482, 483, 481, 220/476, 751; 224/560, 564, 565
See application file for complete search history.

(56) References Cited

U.S. PATENT DOCUMENTS

| | | | | |
|---|---|---|---|---|
| 2,051,591 | A * | 8/1936 | Brogan | 24/116 A |
| 4,346,912 | A * | 8/1982 | Habib | 280/644 |
| 5,987,670 | A * | 11/1999 | Sims et al. | 5/600 |
| 5,996,675 | A * | 12/1999 | Sturgis | 160/349.2 |
| 6,971,963 | B2 * | 12/2005 | Abel | 473/508 |
| 2007/0056999 | A1 * | 3/2007 | Kahn | 224/250 |
| 2012/0228301 | A1 * | 9/2012 | Gordon | 220/476 |

FOREIGN PATENT DOCUMENTS

| | | | | |
|---|---|---|---|---|
| EP | 279179 | A1 * | 8/1988 | G09F 3/04 |

* cited by examiner

*Primary Examiner* — Alfred J Wujciak
(74) *Attorney, Agent, or Firm* — Justin Brasell; Sandy Brasell

(57) ABSTRACT

A pool caddy for stowing an automatic pool cleaner includes a support tube for providing structural support to the pool caddy. A deck mount disposed on the support tube secures the pool caddy to a pool deck edge. A container disposed on the support tube is configured to hold the automatic pool cleaner. A retainer disposed on the container is configured to secure the automatic pool cleaner to the container and to the support tube. A suction cup disposed on the support tube secures the pool caddy to a pool surface.

4 Claims, 3 Drawing Sheets

POOL CADDY

BACKGROUND OF THE INVENTION

The present invention generally relates to apparatus for operating pool systems, maintaining pool systems, and, more particularly, to an apparatus for stowing an automatic pool cleaner.

Some pools utilize automatic pool cleaners to traverse pool surfaces or to skim the water surface to automatically scrub the pool and collect debris. Automatic pool cleaners provide a convenience of clean pools with minimum effort, but include hoses and skimming or scrubbing devices that may interfere with an enjoyment of the pool. Devices do not allow a user to pick up an automatic pool cleaner and quickly stow it to a side of the pool, while allowing the automatic pool cleaner to remain on.

As can be seen, there is a need for an apparatus for stowing an automatic pool cleaner to a pool edge or deck.

SUMMARY OF THE INVENTION

In one aspect of the present invention, a pool caddy comprises a support tube; a deck hook disposed on a top of the support tube; a suction cup disposed on a lower back side of the support tube; a ball catch disposed to the top of the support tube; an attachment disposed on the support tube at a point along a length of the support tube; a support bracket disposed between an end of the attachment and the support tube; an elastic rope; a ball disposed on an end of the elastic rope, the ball operable to engage the ball catch; and a rope hook disposed on a second end of the elastic rope, the rope hook operable to attach to an end of the support bracket.

In another aspect of the present invention, a pool caddy for stowing an automatic pool cleaner comprises a support tube; a deck mount disposed on the support tube for securing the pool caddy to a pool deck edge; a container disposed on the support tube for holding the automatic pool cleaner; a retainer disposed on the container for securing the automatic pool cleaner to the container and to the support bracket; and a suction cup disposed on the support tube for securing the pool caddy to a pool surface.

These and other features, aspects and advantages of the present invention will become better understood with reference to the following drawings, description and claims.

DETAILED DESCRIPTION OF THE INVENTION

Figure 1:
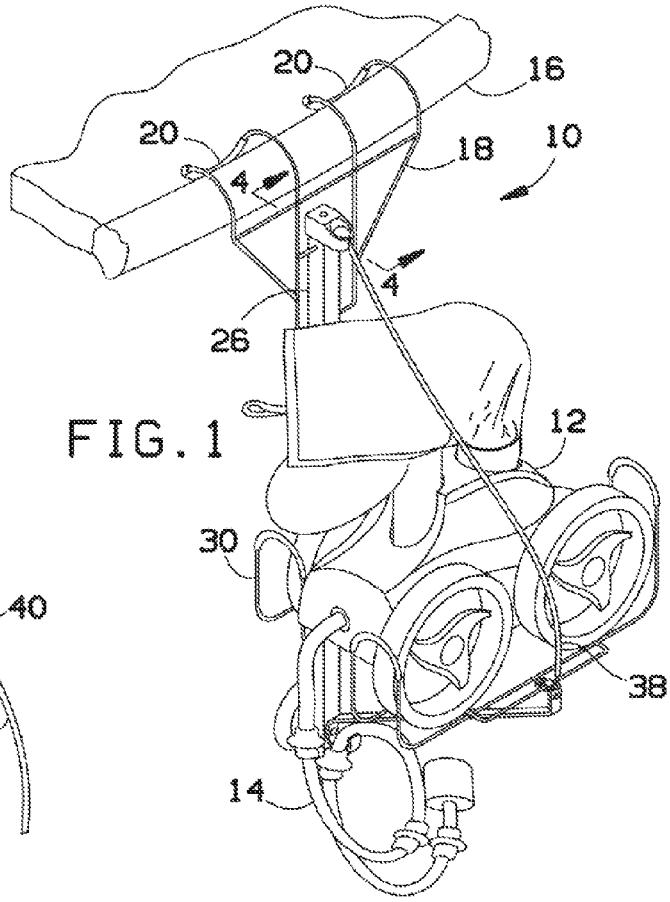
FIG. 1 is an oblique perspective view of a pool caddy with a basket attachment in use according to an exemplary embodiment of the present invention.
Figure 2:
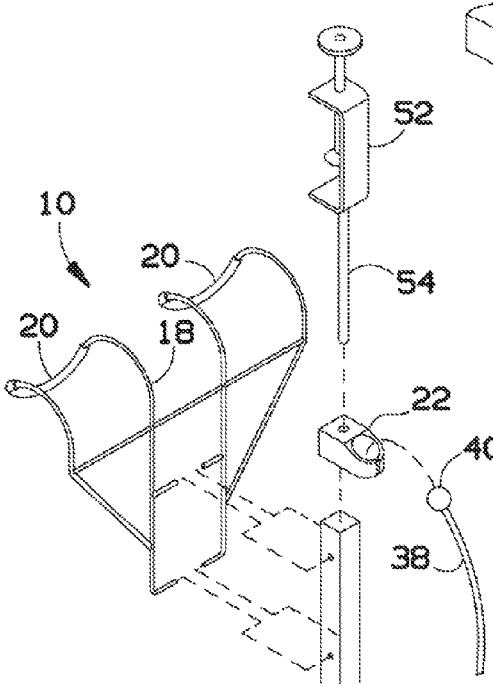
FIG. 2 is an exploded view of the pool caddy of FIG. 1.
Figure 2:
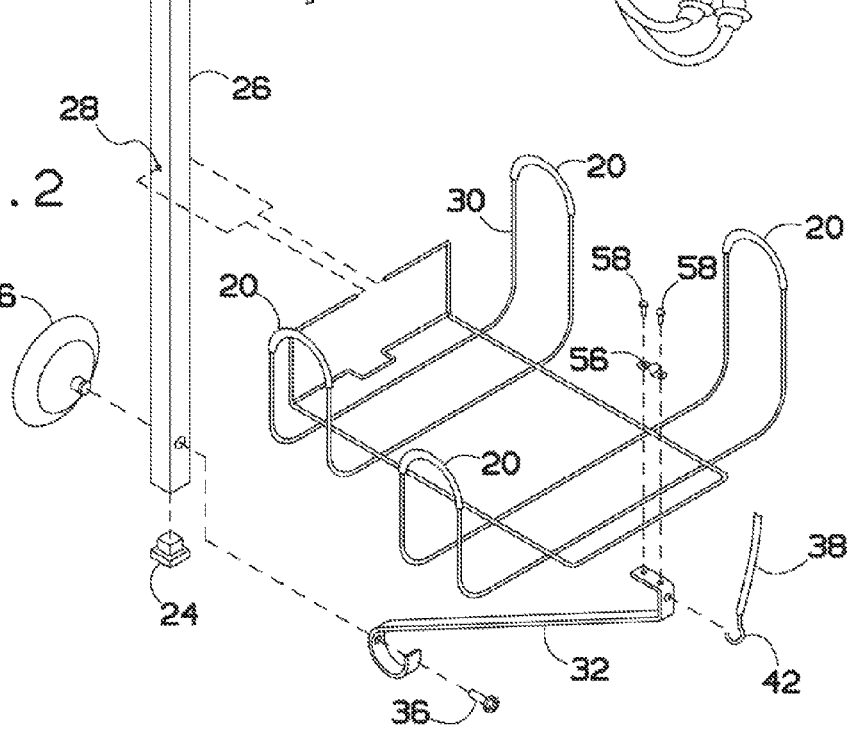

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Various inventive features are described below that can each be used independently of one another or in combination with other features.

Broadly, embodiments of the present invention generally provide a pool caddy apparatus for stowing portions of an automatic pool cleaner to allow the pool cleaner to be set aside an not interfere with use of a pool.

Referring to FIGS. 1-6, a pool caddy 10 may include support tube 26, which may have a wire deck hook 18 assembled thereto, a ball catch end cap 22 on a top end thereof, an end cap 24 on a bottom end thereof, a wire basket 30 assembled thereto, a suction cup 46 assembled thereto, and a support bracket 32 assembled thereto. An elastic rope 38 may have a ball 40 on a first end and an elastic rope hook 42 on a second end thereof. Ball 40 may be configured to engage ball catch end cap 22, which may be configured to also receive a clamp mount shaft 54 of a stone coping clamp 52. Ball catch end cap 22 may be a single molded piece or may include a separable ball catch and an end cap element. Elastic rope hook 42 may be configured to engage or hook onto an end of support bracket 32.

Figure 3:
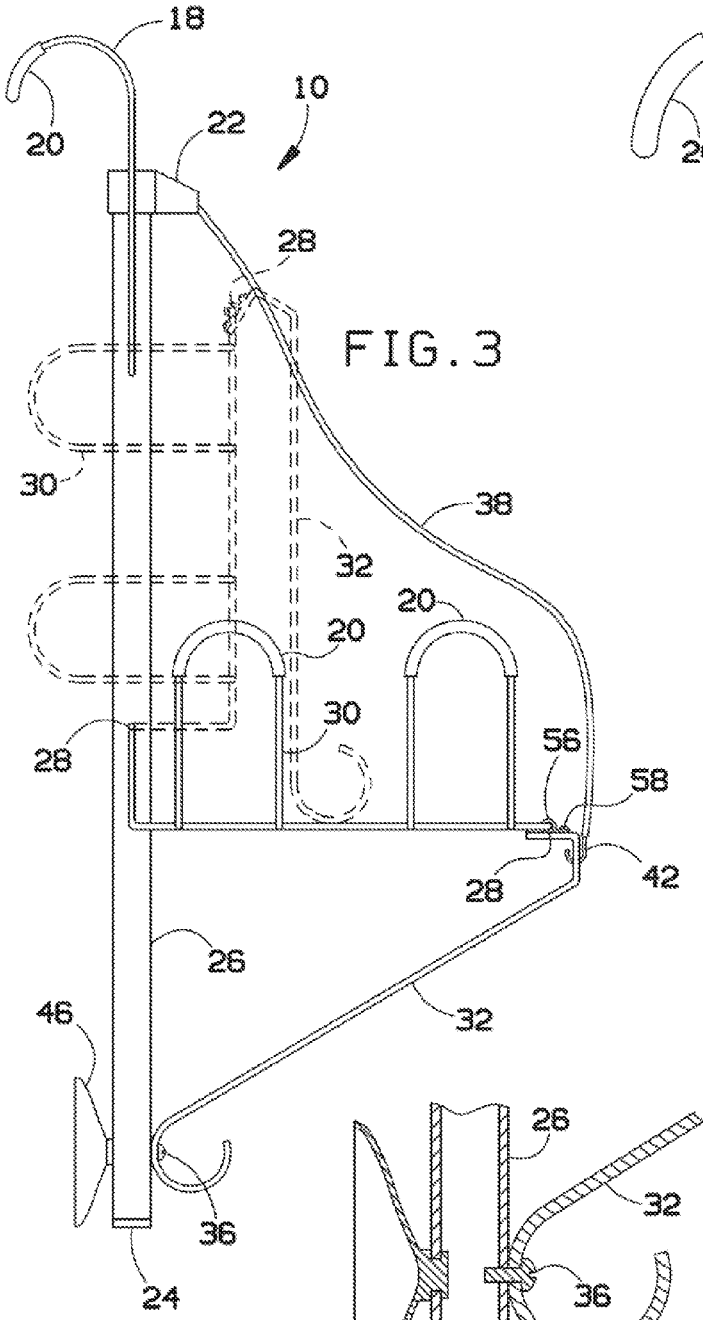
FIG. 3 is a side perspective view of the pool caddy of FIG. 1.
Figure 4:
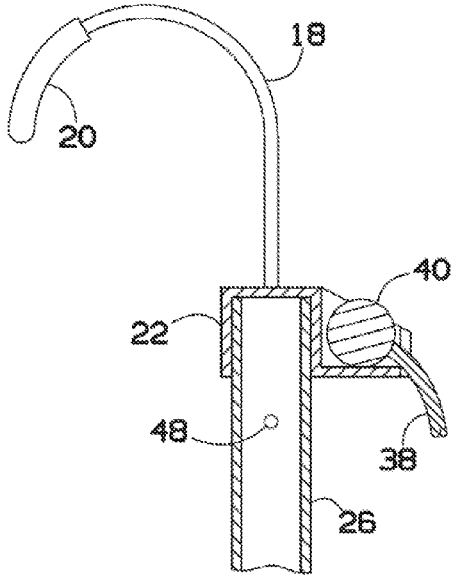
FIG. 4 is a cross sectional view of a ball catch end cap taken along line 4-4 of FIG. 1.
Figure 5:
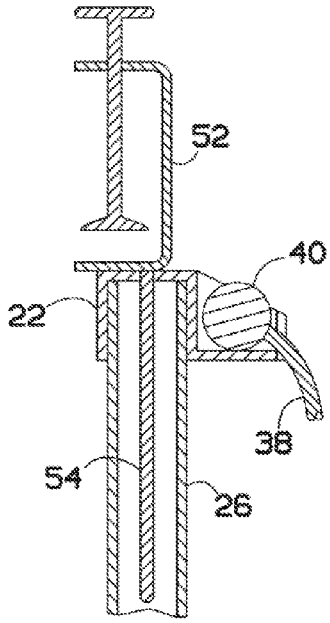
FIG. 5 is a cross sectional view of the ball catch end cap with a coping clamp assembled thereto.
Figure 6:
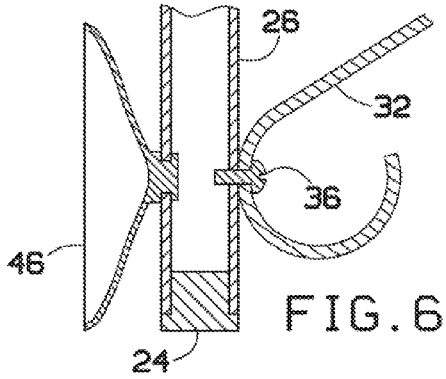
FIG. 6 is a cross sectional view of a bracket and a suction cup of the pool caddy of FIG. 1.

Support bracket 32 may be secured to support tube 26 by a screw 36 or assembled to support tube 26 by an interference fit (e.g., snap fit), and may include a hose hook or other device that may be capable of receiving or holding a pool cleaner hose 14 thereon. Wire basket 30 may be a basket, an attachment, or a container configured to hold or contain a pool cleaner 12 therein. Wire basket 30 may be secured to support bracket 32 by a bracket 56, which may be secured to support bracket 32 by one or more bracket screws 58, and may be configured to allow wire basket 30 to rotate relative to support bracket 32. A pivot point 28 formed or machined in support tube 26 may engage or receive wire basket 30 and allow wire basket 30 to rotate thereabout. Dashed lines in FIG. 3 illustrate wire basket 30 in a rotated configuration. One or more deck hook mount holes 48 formed or machined in support tube 26 may engage or receive wire deck hook 18. Wire deck hook 18 may be configured to hook or grapple on to an edge of pool deck 16. One or more segments of a rubber tubing 20 may encase portions of wire deck hook 18 or wire basket 30, to protect surfaces of a pool deck 16, pool cleaner 12, a user, or wire deck hook 18 and wire basket 30 themselves from abrasion or snagging.

Figure 7:
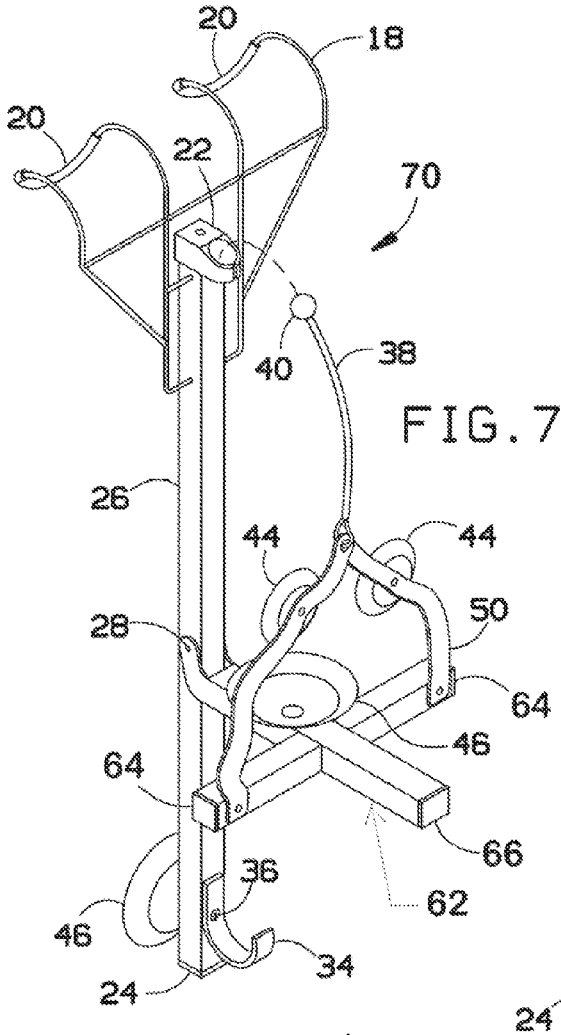
FIG. 7 is an oblique perspective view of a pool caddy according to another embodiment of the present invention.

Referring to FIG. 7, another exemplary embodiment of the present invention is shown. A cross member 62 may be connected to support tube 26 at pivot point 28, and configured to rotate thereabout relative to support tube 26. Cross member 62 may include side supports 64 that may be connected to a pivot bar 66. A webbing 50, which may include a nylon webbing or a rubber strap, may be connected to side support 64 and to elastic rope 38, wherein webbing 50 and elastic rope 38 may be configured, individually or in combination, to hold or retain automatic pool cleaner 12 in pool caddy 70. A suction cup 44 may be connected to webbing 50. One or more end caps 24 may be assembled to distal ends of side support 64 and pivot bar 66. A hose hook 34 may be attached to support tube 26 at a bottom end thereof.

Figure 8:
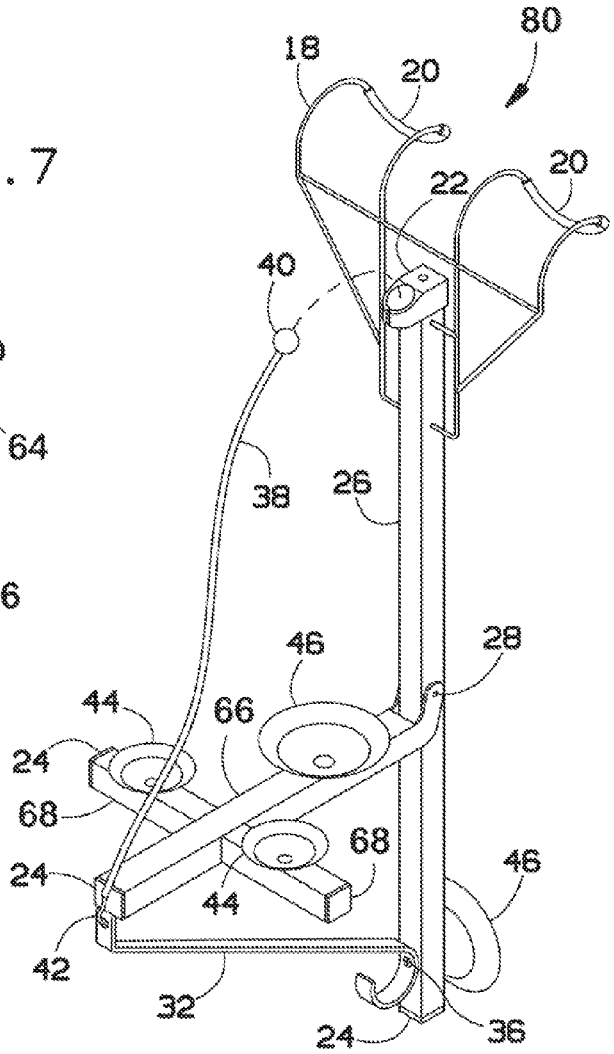
FIG. 8 is an oblique perspective view of a pool caddy according to still another embodiment of the present invention.
Figure 9:
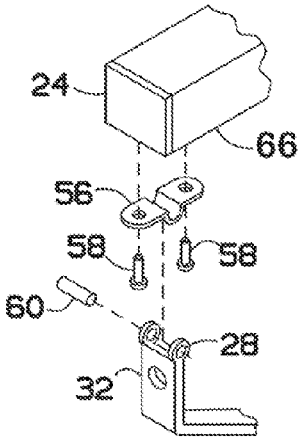
FIG. 9 is a detail view of an aspect of the pool caddy of FIG. 8.

Referring now to FIGS. 8-9 yet another exemplary embodiment of the present invention is shown. Pool caddy 80 may include one or more side suction supports 68, which may be connected to pivot bar 66, and which may have one or more suction cups 44 respectively connected thereto. A distal end of support bracket 32 may have a pin 60 assembled thereto, which may be secured by bracket 56 and one or more bracket screws 58. Pin 60 may allow support bracket 32 to rotate thereabout relative to cross member 62.

According to some exemplary embodiments, support tube 26 may be a rigid metal or polymer tube, rod, or other element capable of providing a rigid structural support for pool caddy 10, and may be aluminum, polyvinyl chloride (PVC), other polymer, metal, or a combination thereof, for example. Wire deck hook 18 and wire basket 30 may include drawn and formed metal wire that may be coated (e.g., rubberized) to protect the metal wire from corrosion or environmental elements. Clamp mount shaft 54 may be configured to secure stone coping clamp 52 to ball catch end cap 22 by an interference fit, for example. In one embodiment, clamp mount shaft 54 may be threaded into ball catch end cap 22 or may be a slip bar. Webbing 50 may be a woven webbing (e.g., nylon webbing) or a strap (e.g., rubber strap) that may be in a V-shaped configuration. Webbing 50 may be treated to be UV resistant or chemical resistant. Hose hook 34 may be attached to a distal end of cross member 62.

According to some exemplary embodiments, suctions cups 44, 46 may be about 2 or about 3 inch suction cups, and may be connected to support tube 26, pivot bar 66, webbing 50, and side suction supports 68 by an interference fit or a fastener, for example. Support tube 26 may be about 24 inches in length.

It should be understood, of course, that the foregoing relates to exemplary embodiments of the invention and that modifications may be made without departing from the spirit and scope of the invention as set forth in the following claims.

What is claimed is:

1. A pool caddy for stowing an automatic pool cleaner, comprising:

a support tube;

a deck hook disposed adjacent to a top of the support tube for mounting on a deck adjacent to a pool surface;

a suction cup disposed on a lower back side of the support tube;

a ball catch disposed to the top of the support tube;

an attachment disposed on the support tube for stowing the automatic pool cleaner;

a support bracket disposed one the tube, having two ends, one of end supporting the attachment and the other end mounted on the bottom of support tube;

a rope;

a ball disposed on a first end of the rope, the ball operable to engage the ball catch; and a hook disposed on a second end of the rope, the hook operable to attach to an end of the support bracket, wherein the rope retains the automatic pool cleaner when it is being stowed in the attachment.

2. The pool caddy of claim 1, wherein the attachment is a basket, the pool caddy further comprising:

a pivot point formed at a second point along the length of the support tube, wherein the pivot point is configured to receive the attachment;

a bracket securing the attachment to the end of the support bracket, wherein the bracket is operable to allow the attachment to rotate thereabout relative to the support bracket; and a deck hook mount hole formed at a third point along the length of the support tube, wherein the deck hook mount hole is operable to engage the deck hook, wherein the support tube is one of an aluminum tubing or a molded plastic tubing.

3. The pool caddy of claim 2, further comprising rubber tubing, the rubber tubing being disposed on a segment of the deck hook and on a segment of the attachment.

4. The pool caddy of claim 3, further comprising a coping clamp, wherein the coping clamp includes a mount shaft assembled to the ball catch.

* * * * *